US005203268A

United States Patent [19]

Schips

[11] Patent Number: 5,203,268

[45] Date of Patent: Apr. 20, 1993

[54] APPARATUS FOR SEWING ELASTIC HEMS ON FABRIC PIECES

[75] Inventor: Helmut Schips, St. Gallen, Switzerland

[73] Assignee: Schips AG Nahautomation, Tubach, Switzerland

[21] Appl. No.: 611,521

[22] Filed: Nov. 13, 1990

[30] Foreign Application Priority Data

Nov. 13, 1989 [EP] European Pat. Off. ..... 89121012.2

[51] Int. Cl.[5] ..... D05B 35/02; D05B 35/10; D05B 27/10

[52] U.S. Cl. ..... 112/121.27; 112/141; 112/147; 112/152; 112/322; 112/306; 112/153

[58] Field of Search ..... 112/121.27, 121.26, 112/141, 152, 63, 322, 305, 147, 262.2, 318, 306, 153

[56] References Cited

U.S. PATENT DOCUMENTS

| | | | |
|---|---|---|---|
| 4,441,438 | 4/1984 | Takahashi | 112/121.27 X |
| 4,458,610 | 7/1984 | Dowell | 112/147 |
| 4,473,017 | 9/1984 | Letard et al. | 112/147 X |
| 4,681,051 | 7/1987 | Kirch et al. | 112/322 X |
| 4,998,965 | 3/1991 | Easom | 112/152 X |

FOREIGN PATENT DOCUMENTS

| | | | |
|---|---|---|---|
| 1152004 | 7/1963 | Fed. Rep. of Germany | 112/121.27 |
| 89-08766 | 9/1989 | Fed. Rep. of Germany . | |
| 2393869 | 2/1979 | France | 112/322 |
| 62-295686 | 12/1987 | Japan | 112/121.27 |
| 1406822 | 9/1975 | United Kingdom | 112/121.27 |
| 1445391 | 8/1976 | United Kingdom . | |
| 2229199 | 9/1990 | United Kingdom | 112/147 |

*Primary Examiner*—Clifford D. Crowder
*Assistant Examiner*—Paul C. Lewis
*Attorney, Agent, or Firm*—Dickstein, Shapiro & Morin

[57] ABSTRACT

An apparatus for sewing elastic hems on fabric pieces is designed as a tandem machine. In a first sewing machine (26a), an elastic band (6) is prefixed at the edge of a fabric piece (8). During further conveyance thereof, the thus created double-ply structure is folded by 180° by a baffle plate (34). A pair of conveying rollers (36, 38) withdraws the double-ply structure from the baffle plate. Between the first sewing machine (26a) and a second sewing machine (26b), provided for finishing the elastic hem, there is provided a deflection roller (40) deflecting the triple-ply structure, formed by said folding and consisting of fabric edge portion, an elastic band, and a fabric folding portion, from the horizontal. The deflection roller (40) is driven in a direction opposite to the conveying direction and thus takes care that the triple-ply structure, also in case of curved seams, remains closed and is sewn correctly.

11 Claims, 3 Drawing Sheets

APPARATUS FOR SEWING ELASTIC HEMS ON FABRIC PIECES

The invention relates to an apparatus for sewing elastic hems on fabric pieces.

Such apparatus are used in particular for making underwear, but also for making swimsuits, sports pants and trousers and the like. Such an apparatus is described in DE-OS No. 37 04 856. In a first step—preferably with the aid of an apparatus designed as a tandem machine—an elastic band is sewn to the fabric piece along an edge thereof. Thereafter, folding of the fabric piece edge takes place such that the elastic band constitutes a triple-ply structure together with the fabric edge. This triple-ply structure is then finished by a second sewing machine either in the form of a single seam or in the form of a double seam.

The known apparatus deals specifically with the problem of sewing the elastic band and the fabric together without the formation of creases. For achieving this, there is provided in the region of the sewing location of the second sewing machine a gas nozzle assembly blowing the fabric away from the sewing location and, thus, also from the triple-ply structure and, consequently, effecting fabric tightening. This apparatus is suited for sewing elastic hems on fabric pieces in largely automatic manner.

Straight seams can be sewn in relatively unproblematic manner, both as regards linear seams and as regards circular seams. Preferably so-called tandem machines are employed. However, problems arise with so-called curved seams, i.e. seams having a more or less great curvature in the fabric plane. Curved seams have the tendency that the "triple-ply structure" opens after pre-fixing of the elastic band and prior to the final sewing or finishing operation. While in case of straight seams the triple-ply structure remains virtually closed prior to finishing, and the elastic band thus remains covered by the folded fabric edge portion, the triple-ply structure opens in case of curved seams so that it has been necessary heretofore to sew curved seams in two separate operations. Consequently, not only two machines are required, but it is also necessary to have two working places, so that curved seams so far have been virtually twice as expensive in manufacture as straight seams.

It is the object of the invention to provide an apparatus for sewing elastic hems on fabric pieces, of the type indicated at the outset, which is adapted to provide also curved hems with good quality.

According to one aspect of the invention, the folding means is designed as a baffle plate which is disposed immediately downstream of the first sewing machine and from the exit end of which is withdrawn the triple-ply structure, rotated by approx. 180°, by means of a pair of conveying rollers, and in that between said pair of conveying rollers and said second sewing machine there is disposed a deflection roller deflecting said triple-ply structure from its horizontal path of movement.

The apparatus according to the invention is designed in particular as a tandem machine. Both "sewing machines" are driven in synchronism, just as the pair of conveying rollers and the deflection roller are driven in synchronism.

By means of the deflection roller, the semi-finished hem, i.e. the triple-ply structure of fabric edge portion/elastic band/fabric folding portion, is deflected from the horizontal path of movement proper, with the consequence that the triple-ply structure is tensioned and opening thereof between said first and second sewing machines is prevented. As a result thereof, the closed triple-ply structure is fed to the second sewing machine and can be sewn there correctly. The conveying rollers, just as the deflection roller, preferably have horizontal axes of rotation. It has turned out as particularly advantageous when the pair of conveying rollers is disposed on the first sewing machine and comprises a lower, rigid roller as well as an upper roller that is biased against the lower roller by spring force. With this arrangement of the conveying rollers, the triple-ply structure is safely withdrawn from the first sewing machine and advanced. Maintenance of the closed condition of the triple-ply structure is enhanced in particular in that the deflection roller is driven in a direction opposite to the direction of movement of the triple-ply structure, the deflection roller being preferably driven by the same motor as the conveying rollers. Especially with curved seams, the triple-ply structure remains closed between the first and second sewing machines and is fed, in the closed condition, to the second sewing location where the hem is finished. Depending on the specific configuration of the seam, it may possibly be sufficient to have such an arrangement of the deflection roller that the triple-ply structure is deflected by only approx. 20° with respect to the horizontal, however, in specific cases the deflection roller may be arranged such that deflection of up to 60° takes place with respect to the horizontal.

The problem indicated hereinbefore is met according to the invention, furthermore, in that the folding means is designed as a reversing plate of approx. U-shaped cross-section which is disposed downstream of the first sewing machine and which, between the entry end facing the first sewing machine and the exit end facing the second sewing machine, is twisted along its longitudinal axis by approx. 180°. In this preferred embodiment, the conveying rollers and the deflection roller can be dispensed with. While in the first embodiment the baffle plate is a bent plate, the U-shaped cross-section of the reversing plate according to the present embodiment provides a guide channel whose lateral opening at the entry end permits passage of the fabric, while the edge portion of the fabric together with the fixed elastic band passes between the two legs of the "U"-shape. While the material is advanced between first and second sewing machines, reversing of edge portion is carried out. When the edge portion of the fabric was first located on top of the elastic band, this edge portion is then transferred underneath the elastic band due to the folding or reversing operation, and a further strip of the fabric is then located on top of the elastic band, thereby forming the triple-ply structure, while the fabric portion at the exit end of the reversing plate passes across the outer surface of the one leg of the "U"-shape. Depending on the design of the apparatus as a whole, the reversing plate may be relatively short. It is possible to arrange a reversing plate of a length of approx. 250 mm shortly downstream of the first sewing machine, e.g. 25 mm downstream of the first sewing machine, while the exit end is located approx. 50 mm upstream of the second sewing location.

For the largely automatic sewing of elastic hems, further aspects must be considered as well for ensuring a good quality of the products: after folding, the fabric must abut the elastic band in creaseless manner, since the elastic hem will then become distorted in undesirable manner. Thus, the fabric at all times should smoothly abut the edge of the elastic band or should at least have at all times a constant positional relationship with respect to the elastic band. Even when care is taken that the fabric smoothly abuts the edge of the elastic band, a wavy seam may nevertheless be created, which is due to the following: during sewing, the triple-ply structure with the elastic band contained therein is stretched. Such stretching entails a cross-sectional reduction of the elastic band. After the finishing or final sewing operation, the elastic band relaxes, whereby the cross-section resumes its original, relatively large value. In doing so, the undesired wavy seam is created.

For counteracting this problem, an independent inventive idea, with respect to an apparatus for sewing elastic hems, consists in that the feeding means feeding the triple-ply structure for the finishing operation comprises a spacer member projecting, i.e. engaging, into the triple-ply structure upstream of the sewing location and creating a predetermined free space between the elastic band and the inner portion of the folding edge. This free space takes into account the cross-section of the elastic band that is reduced during sewing, and provides room for the subsequent expansion of the elastic band to its original cross-section. Subsequent to the second sewing location, the elastic band, having resumed its large crosssection, fills out the free space created by the spacer member so that wavy seams are reliably prevented. The spacer member preferably is a spacer plate having a sliding edge.

The use of the spacer member is particularly advantageous when a fabric tightener or tautener is provided at the same time. The latter may be in principle a gas nozzle ) assembly as proposed for instance in the aforementioned DE-OS No. 37 04 856. However, according to an individual idea of the invention, the fabric tautener is provided in the form of a driven round brush brushing the fabric away from the triple-ply structure - substantially at right angles thereof.

BRIEF DESCRIPTION OF THE DRAWINGS

Embodiments of the invention will now be elucidated in more detail with reference to the drawings in which.

DETAILED DESCRIPTION OF PREFERRED EMBODIMENTS

Figure 1A:
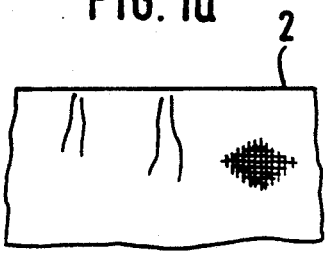
FIG. 1*a* shows a fabric piece having a straight seam.
Figure 1B:
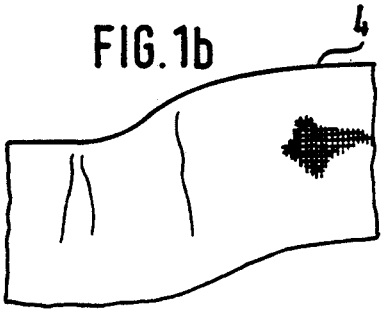
FIG. 1*b* shows a fabric piece having a curved seam.

FIG. 1*a* schematically depicts a fabric piece having a straight seam 2. FIG. 1*b* schematically depicts a fabric piece having a curved seam 4. Seam 4 is curved in the plane of the fabric piece. The apparatus described herein is adapted to carry out both seam types 2 and 4 in good quality. The seams depicted in FIGS. 1*a* and 1*b* are so-called linear seams, i.e. seams that are open at both ends. The apparatus according to the invention can also be used to make closed seams, so-called circular seams. In the instant case, the seams are elastic hems.

Figure 2:
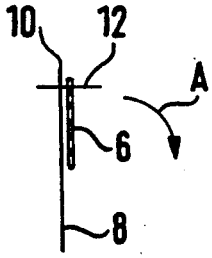
FIG. 2 shows a sectional view of a fabric piece with prefixed elastic band.

FIG. 2 illustrates the appearance of the future elastic hem after pre-fixing thereof. The term "pre-fixing" as used herein comprises the provisional basting of an elastic band to the fabric, in order to finish the elastic hem subsequently by means of a double-head needle machine, however, the term "pre-fixing" can also be understood herein to the effect that the elastic band is first attached to the fabric by way of a first seam, and a second seam is added after folding of the fabric edge.

Figure 3:
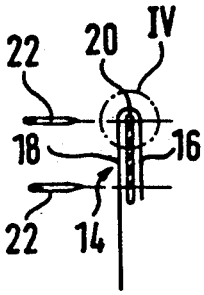
FIG. 3 shows the finished condition in which fabric is folded around the elastic band.

An elastic band 6 is pre-fixed on a fabric piece 8 along an edge 10 of the fabric 8 by means of a seam 12, the stitch seam 12 extending approximately parallel to edge 10 as well as close to this edge and along a longitudinal edge of the elastic band 6. FIG. 3 shows the condition in which the elastic band, together with a fabric portion abutting one side thereof, has been rotated by 180° in accordance with arrow A in FIG. 2. Thus, a triple-ply structure 14 is formed, consisting of a fabric edge portion 16, the elastic band 6 and a fabric folding portion 18, with the elastic band 6 being located between the fabric portions 16 and 18 and the fabric 8 being folded about the longitudinal edge 20 of the elastic band 6 remote from the stitch seam 12. The fabric 8 extends away from the triple-ply structure 14 in continuation of the fabric folding portion 18. 22 designates two needles of a sewing-machine which are used to finish the triple-ply structure 14, with both seams that are created during this finishing or final sewing operation extending parallel to each other and relatively close to the two longitudinal edges of the elastic band 6.

Figure 4:
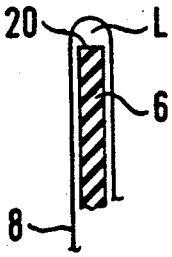
FIG. 4 shows an enlarged detailed view of the detail IV indicated in FIG. 3, FIGS. 5*a* and 5*b* show schematic cross-sectional views of a smooth correct hem and of a wavy hem, respectively.
Figure 5A:
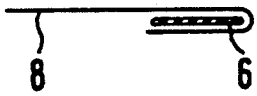
Figure 5B:
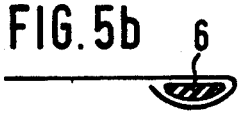

Before the machine according to the invention is explained in detail, some problems arising in sewing elastic seams shall be elucidated with reference to FIGS. 4 and 5*a* and 5*b*: FIG. 4 shows detail IV of FIG. 3 in an enlarged scale. Between the upper longitudinal edge 20 of elastic band 6 and the inner "bending edge" of fabric 8, a free space L is left free in the region of the sewing location where the elastic hem is finished. The reason for this free space L is as follows: during sewing, the elastic band 6 will be stretched, thereby causing a cross-sectional reduction of the elastic band. After sewing, the elastic band relaxes and resumes the relatively large cross-sectional area. In case there is no room left then in the region of the triple-ply structure into which the elastic band 6 can expand, the seam will bulge, thus creating a wavy seam as schematically depicted in FIG. 5*b*. For avoiding this effect, the free space L is created between the longitudinal edge 20 of the elastic band 6 and the inner portion of the folding edge, by employing means that will still be elucidated in more detail hereinafter, and the relaxed or unstretched elastic band 6 can expand into this free space, so that a smooth, even seam is finally created as outlined in FIG. 5*a*.

Figure 7:
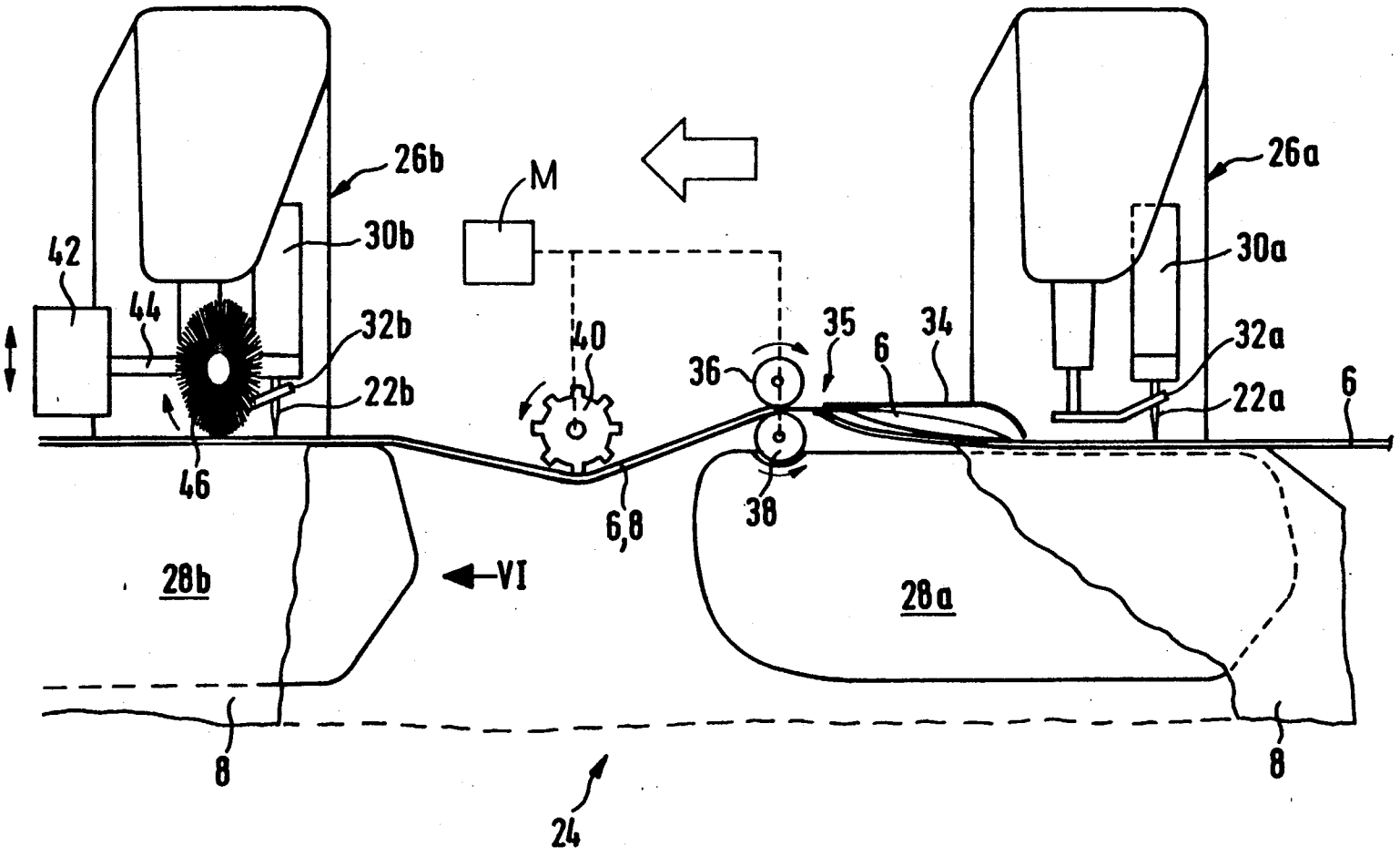
FIG. 7 shows a schematic overall view of a tandem machine.

FIG. 7 illustrates a schematic view of a tandem machine 24 by means of which the elastic seam shown in FIGS. 3, 4 and 5*a* can be made largely in automatic manner. The tandem machine 24 according to FIG. 7 comprises a first sewing machine 26*a* on the right-hand side in FIG. 7 and a second sewing machine 26*b* on the left-hand side in FIG. 7. The conveying direction of the material to be sewn is from right to left. The two sewing machines 26*a* and 2*b*, being part of the tandem machine, may be of similar construction. Preferably, they are driven in synchronism. Like parts in both machines 26a and 26b will be described in more detail only once.

The first sewing machine 26a contains as an essential constituent part a sewing material supporting base 28a. On the arm of the machine, there are provided a needle head 30ahaving a sewing needle 22a, and a sewing foot 32a. The fabric conveying means are not shown in the drawing. The material to be sewn comprises the elastic band 6 and a fabric piece 8 shown partly cut away here so that details of the tandem machine 24 are visible more clearly.

The material to be sewn, in the manner shown in FIG. 2, is fed across the sewing material supporting base 28a past the sewing location, such that after leaving the sewing location, exactly the double-ply structure shown in FIG. 2 has been established. The edge portion is rotated once by 180° about its longitudinal axis, at a guide or baffle plate 34 disposed immediately adjacent the sewing location of the first sewing machine 26a. The triple-ply structure 14 (cf. FIG. 3) is withdrawn from an exit end 35 of the baffle plate 34 by means of a pair of conveying rollers. The pair of conveying rollers is disposed at the end of the sewing material supporting base 28a. A lower roller 38 is rigidly supported on the sewing machine. An upper conveying roller 36 is urged against the lower conveying roller 38 by means of a spring assembly which is not shown herein. The rollers rotate in the directions indicated by arrows, so that the material 6, 8 to be sewn is moved on towards the left. Between the two sewing material supporting bases 28a and 28b of the two sewing machines, there is provided a deflection roller 40 driven in a direction opposite to the moving direction of the material 6, 8 to be sewn. The axes of the conveying rollers 36 and 38, just as the rotational axis of the deflection roller 40, are oriented horizontally as well as perpendicularly to the drawing plane. The position of the deflection roller 40 is chosen such that the triple-ply structure is deflected from the otherwise virtually horizontal conveying path; the angle in this respect should be approx. 35°. The deflection roller 40 is driven by the same D.C. motor M as the conveying rollers 36, 38, however, the direction of rotation of the deflection roller 40 is opposed to the direction of movement of the material to be sewn .The effect achieved thereby is that the triple-ply structure remains closed also in case of curved seams, i.e. that it has substantially the configuration outlined in FIG. 3. This is particularly important in the region where the triple-ply structure is fed to the sewing the needle head 30b is provided—for instance—with a double head needle 22b which firmly connects the elastic band 6 to the fabric in accordance with FIG. 3. In the region of the sewing location, the second sewing machine 26b has a fabric tautener or tightener which in the embodiment shown is present in the form of a round brush 46 located at the end of a shaft 44 held and rotated by a carrier/drive 42. The round brush 46 rotates in the direction indicated by an arrow in order to withdraw the fabric 8 from the sewing location.

Figure 6:
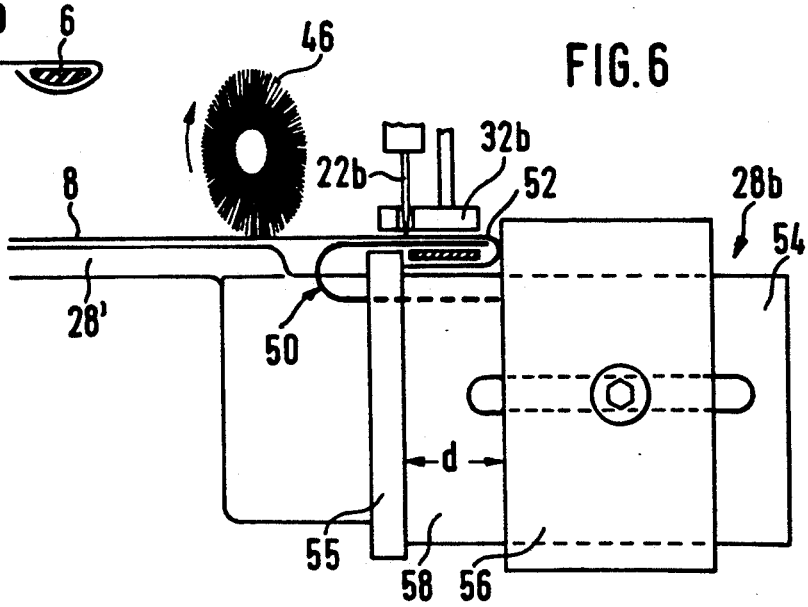
FIG. 6 shows a schematic view of a guide means.

The region of the sewing location is shown in more, detail in FIG. 6. FIG. 6 shows in essence the guiding means of the sewing machine 26b. On a curved of the sewing material supporting base 28b, there is disposed an outer body 56 in adjustable manner. A shoulder 55 of the inner body, together with the edge of the outer body located on the left-hand side in FIG. 6, constitutes a channel 58 whose width d is defined by a corresponding adjustment of the outer body 56. Projecting from this inner body 54 is a spacer plate 50 which is of approx. U-shaped configuration and projects with the end of its upper leg into the three-ply structure at a position in front of the sewing location, such that it abuts, with a sliding edge 52 formed at the end of said U-leg, on the inner folding edge of the fabric. The elastic band is spaced from this inner edge by a certain distance. This is how the free space designated L in FIG. 4 is formed between the elastic band and the folding edge of the fabric.

The round brush 46 is arranged in a slightly inclined position so that the fabric is brushed away from the sewing location towards the left and somewhat in the conveying direction of the material to be sewn. The fabric is thus smooth in the region of the sewing location. The fabric 8 may then rest on a table-like extension 28' of the sewing material supporting base. The spacer member 50 can be dispensed with when the elastic band is of low elasticity. In that case, the round brush 46 will take care that the fabric smoothly abuts the longitudinal edge 20 of the elastic band in order to thus avoid crinkling of the seam.

Figures 8, 9:
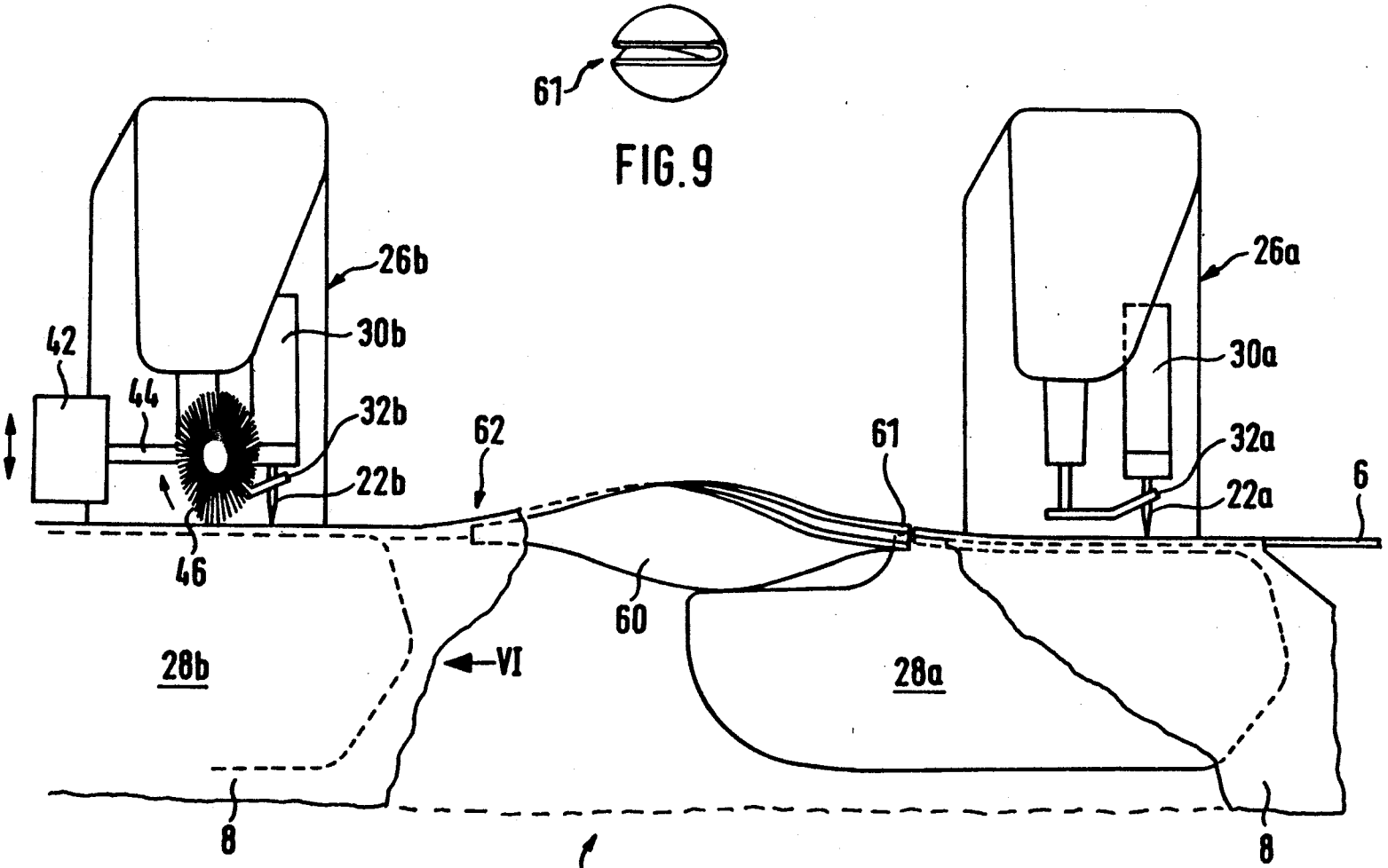
FIG. 8 shows a schematic overall view of a further preferred embodiment of a tandem machine.
FIG. 9 shows a view of the reversing plate shown in FIG. 8, as seen from the, entry end.

FIG. 8 shows an embodiment that is simplified as compared to the embodiment of FIG. 7 and is, thus, preferred. In this embodiment, the folding means consists of a reversing plate 60 of U-shaped cross-section, with the depth between the legs of the "U"-shape being somewhat greater than the width of the elastic band 6. (Like numerals as in FIG. 7 are used to designate corresponding parts, and a description thereof will not be repeated).

The reversing plate 60 has its entry side 61 disposed shortly downstream of the sewing location of the first sewing machine 28a. In FIG. 8, the viewer looks into the open channel in the region of the entry end 61. The U-shaped cross-section, as seen along the longitudinal axis thereof, performs a rotation about said longitudinal axis by 180°, so that at the exit end 62 of the reversing plate 60, the lateral opening is directed into the drawing plane.

FIG. 9 clearly illustrates the U-shaped cross-section at the entry end. At this end, the edge portion of the fabric piece 8, together with the elastic band 6 fixed thereon on the bottom side, enters the reversing plate 60. The edge portion and the elastic band 6 are rotated by 180°, so that at the exit end 62 the previously upwardly facing edge portion of the fabric is now facing downwardly, while a laterally adjoining strip of the fabric is now located on top of the elastic band, as shown essentially in FIGS. 4 and 5a. Due to the folding or reversing operation of the edge portion together with the elastic band 6 fixed thereon, according to FIG. 8, the fabric piece 8 is somewhat pulled upwardly in the drawing plane, since the lateral opening of the "U"-shape, due to the rotation in the conveying direction (from right to left in FIG. 8), describes a rightward twist.

I claim:

1. An apparatus for sewing a curved elastic hem on a fabric pieee, said apparatus comprising:

a first sewing machine for fixing an elastic band along an edge portion of the fabric piece;

folding means for folding the fabric piece, at a folding portion, about a longitudinal edge of the elastic band while said fabric piece and said elastic band are being conveyed, and for thereby forming a triple-ply structure formed of the folding portion, the elastic band, and the edge portion of the fabric piece; and a second sewing machine for finishing the triply-ply structure; and wherein said folding means includes a baffle plate for rotating the triple-ply structure by approximately 180°, said baffle plate being located immediately downstream of said first sewing machine, and said baffle plate having an exit end ; and wherein said apparatus further includes conveying rollers for withdrawing the triple-ply structure from said exit end of said baffle plate; and wherein said apparatus further includes a deflection roller for deflecting said triple-ply structure from a horizontal path of movement, said deflection roller being located between said conveying rollers and said second sewing machine.

2. An apparatus according to claim 1, wherein the conveying rollers as well as the deflection roller have horizontal axes of rotation.

3. An apparatus according to claim 1, wherein the conveying rollers are arranged on the first sewing machine (26*a*), said conveying rollers including a lower, rigid roller (38) and an upper roller (36).

4. An apparatus according to claim 1, wherein the deflection roller (40) is driven in a direction opposite to the direction of movement of the triple-ply structure.

5. An apparatus according to claim 1, wherein the conveying rollers (36, 38) are driven by a motor, and wherein the deflection rollers (36, 38) are driven by a motor, and wherein the deflection roller (40) is driven by said motor.

6. An apparatus according to claim 1, wherein the deflection roller (40) has a corrugated surface.

7. An apparatus according to claim 1, wherein the deflection roller is arranged such that the triple-ply structure assumes an angle of approximately 20° to 60° with respect to the horizontal.

8. An apparatus according to claim 1, further comprising a guiding means (54-58) for guiding the triple-ply structure (14), said guiding means including a spacer member (50, 52) for projecting into the triple-ply structure and for creating a predetermined free space (L) between the elastic band (6) and and inner portion of the folding edge.

9. An apparatus according to claim 8, wherein said spacer member includes a spacer plate (50) having a sliding edge (52) for internally abutting the folding edge.

10. An apparatus according to claim 8, wherein said second sewing machine further includes a fabric tautener (46).

11. An apparatus according to claim 10, wherein said fabric tautener includes a driven round brush (46) for brushing the fabric away from the triple-ply structure.

* * * * *